US006927767B1

(12) United States Patent
Ouchi

(10) Patent No.: US 6,927,767 B1
(45) Date of Patent: Aug. 9, 2005

(54) PICTURE DISPLAY APPARATUS

(75) Inventor: Akihiro Ouchi, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/492,568

(22) Filed: Jan. 28, 2000

(30) Foreign Application Priority Data

Jan. 29, 1999 (JP) ..... 11-022752

(51) Int. Cl.[7] ..... G09G 5/00

(52) U.S. Cl. ..... 345/213; 345/699; 345/3.4; 348/511

(58) Field of Search ..... 345/698, 699, 345/213, 672, 3.4; 348/590, 591, 511, 747, 745

(56) References Cited

U.S. PATENT DOCUMENTS

| | | | | | |
|---|---|---|---|---|---|
| 4,760,387 | A | * | 7/1988 | Ishii et al. | 345/3.1 |
| 5,216,504 | A | * | 6/1993 | Webb et al. | 348/190 |
| 5,293,474 | A | | 3/1994 | Patil et al. | 395/148 |
| 5,600,379 | A | * | 2/1997 | Wagner | 348/497 |
| 5,717,467 | A | | 2/1998 | Shiki | 348/511 |
| 5,909,205 | A | * | 6/1999 | Furuhashi et al. | 345/98 |
| 6,028,586 | A | * | 2/2000 | Swan et al. | 345/581 |
| 6,046,737 | A | * | 4/2000 | Nakamura | 345/213 |
| 6,177,922 | B1 | * | 1/2001 | Schiefer et al. | 345/698 |
| 6,226,045 | B1 | * | 5/2001 | Vidovich | 348/539 |
| 6,329,981 | B1 | * | 12/2001 | Lin et al. | 345/204 |
| 6,348,931 | B1 | * | 2/2002 | Suga et al. | 345/699 |

FOREIGN PATENT DOCUMENTS

| | | | | |
|---|---|---|---|---|
| JP | 05072986 A | * | 3/1993 | 345/11 |
| JP | 7-44125 | | 2/1995 | |
| JP | 10-63234 | | 3/1998 | |

OTHER PUBLICATIONS

Merriam–Webster's Collegiate Dictionary, 10th Ed., 1999, p. 608.*

Microsoft Press Computer Dictionary, 3rd Ed., 1997, p. 255.*

Merriam–Webster's, Collegiate Dictionary, 10th ed. (1999), p. 1196.*

* cited by examiner

*Primary Examiner*—Dennis-Doon Chow
*Assistant Examiner*—Leland R. Jorgensen
(74) *Attorney, Agent, or Firm*—Fitzpatrick, Cella, Harper & Scinto

(57) ABSTRACT

A picture display apparatus for displaying a picture in response to inputted picture signals of an arbitrary format. The apparatus includes a picture display unit having an arranged matrix of dots for picture display, a picture display unit drive for converting inputted picture signals into display picture signals adapted for display on the picture display unit and generating drive timing signals for driving the picture display unit, the picture display unit driver including a picture memory for storing picture signals inputted into the picture memory, a display position detector for detecting a picture display position on the picture display unit based on the display picture signals and the drive timing signals, and a display position controller for controlling a timing of admission of the inputted picture signals to the picture memory of the picture display unit driver, based on the detected display position data from the display position detector. The picture display unit, the picture display unit driver, the display position detector and the display position controller are integrated to form the picture display apparatus for receiving the inputted picture signals of an arbitrary format.

4 Claims, 6 Drawing Sheets

PICTURE DISPLAY APPARATUS

FIELD OF THE INVENTION AND RELATED ART

The present invention relates to a dot matrix-type picture display apparatus with a new type of display picture position adjustment means, particularly suitable for a multiscan-type liquid crystal display or liquid crystal projector to which picture signals of indefinite signal format are inputted.

In recent years, as picture display apparatus for computer apparatus, for example, those of the so-called multiscan-type capable of displaying picture signals having various frequencies (or resolutions) have become popular. In this regard, picture signals inputted from the exterior are not always of a prescribed single format, but even picture signals having an identical resolution can have different horizontal or vertical initial or starting points of display on an entire display picture area or a display panel. This means that the deviation in starting point of a display can lead to a lack of picture display in the case of a dot matrix-type picture display apparatus wherein a picture display region corresponds to a number of display pixels. Accordingly, the picture display apparatus is required to have a means for displaying a picture at an exact position corresponding to an inputted picture signal.

FIG. 5 is a block diagram showing an organization of a conventional picture display apparatus. Referring to FIG. 5, the picture display apparatus includes an A/D converter 1, a picture display unit drive circuit 2, a picture display unit 3, a display control circuit 4, and a preset data memory 5. Based on the organization, analog video signals Ra, Ga and Ba are converted by the A/D converter 1 into digital signals Rd, Gd and Bd, which are then stored at a picture memory contained within the picture display unit drive circuit 2. The time of writing in the picture memory is controlled by the display control circuit 4. At the picture display unit drive circuit 2, picture data processing for producing signals R, G and B suitable for the picture display unit 3 is effected, and drive timing pulses (horizontal synchronizing pulses H, vertical synchronizing pulses V and pixel clock signals CK) are generated. In this organization, the display position adjustment is performed by storing preset picture position data based on expected input signal formats in the preset data memory 5, and judging the inputted signal format by the display control circuit 4 to set the picture display position to the preset value. Accordingly, an accurate position adjustment is impossible for inputted signals other than expected input signals, so that there is provided an adjustment means for allowing an operator to effect a manual position adjustment.

FIG. 6 is a block diagram of another example of conventional picture display apparatus, which includes an A/D converter 1, a picture display unit drive circuit 2, a picture display unit 3, a display control circuit 4, and a picture position detection circuit 6'. Based on this organization, the picture position detection circuit 6' is supplied with converted digital video signals Rd, Gd and Bd, a horizontal synchronizing signal $H_{SYNC}$, a vertical synchronizing signal $V_{SYNC}$ and a dot clock signal DCK. By detecting positions of digital video signals Rd, Gd and Bd corresponding to the horizontal synchronizing signal $H_{SYNC}$ and the vertical synchronizing signal $V_{SYNC}$ by the position detection circuit 6' and based on the results thereof, the display control circuit 4 controls the timing for writing the digital video signals Rd, Gd and Bd in a picture memory contained in the picture display unit control circuit 2, thereby automatically adjusting the picture display position on the display unit (Japanese Laid-Open Patent Application (JP-A) 7-44125 and JP-A 10-63234).

The picture display apparatus of FIG. 5 obviates the need for a manual adjustment for signal formats for which preset values have been set, but for signals of other formats, the operator is required to effect a troublesome manual adjustment of horizontal and vertical positions while observing a picture displayed on the display unit and the adjustment is also difficult. On the other hand, the picture display apparatus of FIG. 6 allows an automatic positional alignment, but in view of higher resolution and higher input signal frequency adopted in recent years, the operation speed of the picture position detection circuit 6' is increased correspondingly to result in an increased current flow and a higher-speed expensive circuit device for realizing the picture position detection circuit 6', thus incurring an increased production and running cost. Particularly, in the case of effecting the picture position adjustment dot by dot, a substantial time is required for display position adjustment to cause a delay in commencement of display.

SUMMARY OF THE INVENTION

In view of the above-mentioned problem of the prior art, a principal object of the present invention is to provide a picture display apparatus equipped with means for detection and automatic adjustment of display position at a reduced current consumption and at a low cost in a dot matrix-type picture display apparatus.

According to the present invention, there is provided a picture display apparatus for displaying a picture in response to inputted picture signals of arbitrary format, comprising:

a picture display apparatus having an arranged matrix of dots for picture display, picture display unit drive means for converting inputted picture signals into display picture signals adapted for display on the picture display unit and generating drive timing signals for driving the picture display unit, display position detection means for detecting a picture display position on the picture display unit based on the display picture signals and the drive timing signals, and display position control means for controlling admission of the inputted picture signals to the picture display unit drive means based on the detected display position data from the display position detection means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
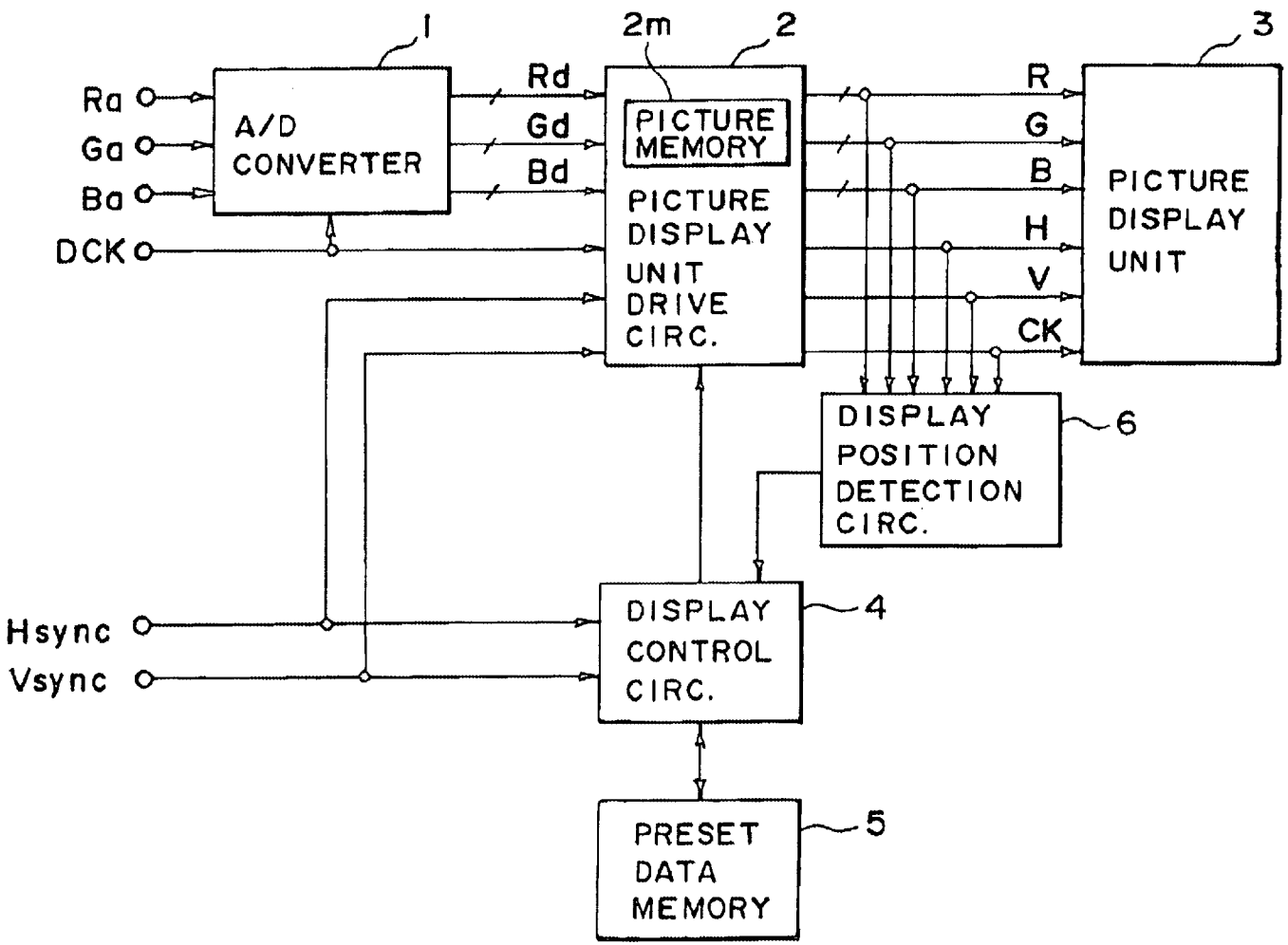
FIG. 1 is a block diagram of an embodiment of the picture display apparatus according to the invention.

Referring to FIG. 1 showing an embodiment of the picture display apparatus according to the present invention, the picture display apparatus includes a picture display unit 3, an A/D conversion circuit 1 for converting inputted analog picture signals Ra, Ga and Ba into digital signals Rd, Gd and Bd, a picture display unit drive circuit 2 for converting the digitally converted video signals Rd, Gd and Bd into display picture signals R, G and B suitable for displaying on the picture display unit 3 and generating drive timing signals for driving the picture display unit 3, a display picture detection circuit 6 for receiving the digital picture signals R, G and B, a horizontal synchronizing signal H, a vertical synchronizing signal V and pixel clock signals CK for the picture display unit 3 prepared by the picture display unit drive circuit 2 to detect horizontally initial and final points and vertically initial and final points for a display picture on the picture display unit 3, a display control circuit 4, and a preset data memory 5, wherein the timing for writing the digital signals Rd, Gd and Bd into a picture memory 2*m* contained in the picture display unit drive circuit 2 is controlled based on the display position detection circuit 6, thereby automatically adjusting a display picture position.

Further, by disposing the display position detection circuit 6 at a later stage than the picture display unit drive circuit 2, the operation speed of the display position detection circuit 6 is restricted within the drive speed of the picture display unit 3, whereby the detection circuit 6 can be operated at a suppressed current consumption and does not require a high-speed device incurring an increased apparatus cost.

Further, by adopting a system sequence or flow of effecting an automatic picture position adjustment immediately before displaying a first picture in the picture display apparatus, it becomes possible to provide a system whereby an operator is not aware of positional deviation of a display picture.

Hereinbelow, the operation of the embodiment will be described in further detail.

As mentioned above while referring to FIG. 1, the picture display apparatus includes an A/D converter 1, a picture display unit drive circuit 2, a picture display unit 3, a display control circuit 4, a preset data memory 5 and a display position detection circuit 6. Inputted analog video signals Ra, Ga and Ba are converted into digital signals Rd, Gd and Bd by the A/D converter 1 based on a dot clock signal DCK, and the digital signals are inputted to the picture display unit drive circuit 2.

The picture display unit drive circuit 2 includes a picture memory 2*m*, and the converted digital video signals Rd, Gd and Bd are once stored in the picture memory 2*m* based on the dot clock signal DCK, and then read out based on a clock signal having a frequency different from that of the dot clock signal DCK to be processed so as to provide display picture signals suitable for display on the picture display unit 3. According to the system organization, the timing of readout from the picture memory 2*m* is fixed, so that the picture display position on the picture display unit 3 is determined by the time when the digital video signals Rd, Gd and Bd are written in the picture memory based on the dot clock signal DCK. More specifically, if the writing in the memory 2*m* is effected at a horizontally early time, the display picture signal is outputted from the picture display unit drive circuit 2 at an early time to provide a picture display position shifted to a right side on the picture display unit 3. On the other hand, if the writing in the picture memory 2*m* is effected at a horizontally late time, the display picture outputted from the picture display unit drive circuit 2 at a later time to provide a picture display position shifted to a left side on the picture display unit 3. Similarly, the writing in the picture memory 2*m* at a vertically early time results in a picture display position shifted to a lower side and the writing in the memory 2*m* at a vertically late time results in a picture display position shifted to an upper side on the picture display unit 3.

The picture display unit drive circuit 2 also generates drive timing pulses (i.e., horizontal synchronizing pulses H, vertical synchronizing pulses V and pixel clock signals CK) for the picture display unit 3. The video signals R, G and B prepared by processing in the picture display unit drive circuit 2 are inputted to the picture display unit 3 along with these timing pulses to display a picture on the picture display unit 3.

Figure 2:
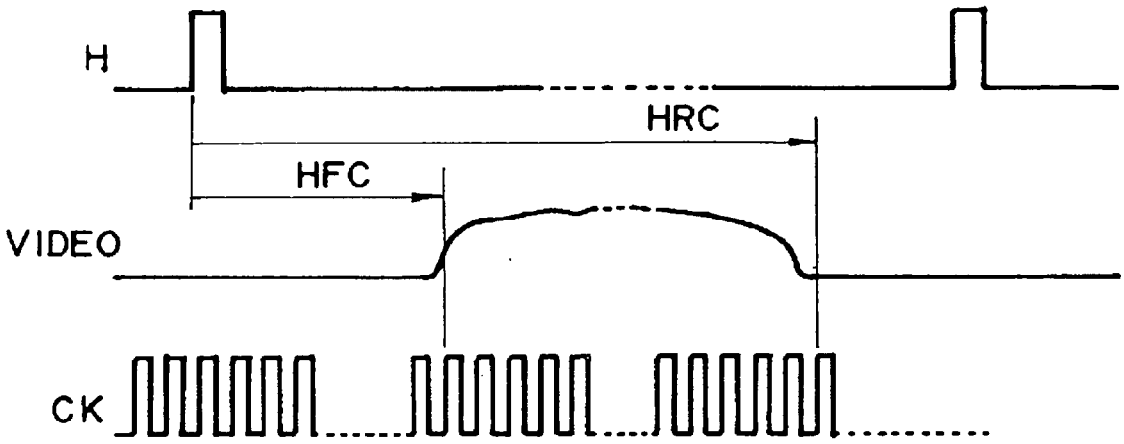
FIG. 2 is a time chart for illustrating an example of a display position relative to a horizontal synchronizing signal.
Figure 3:
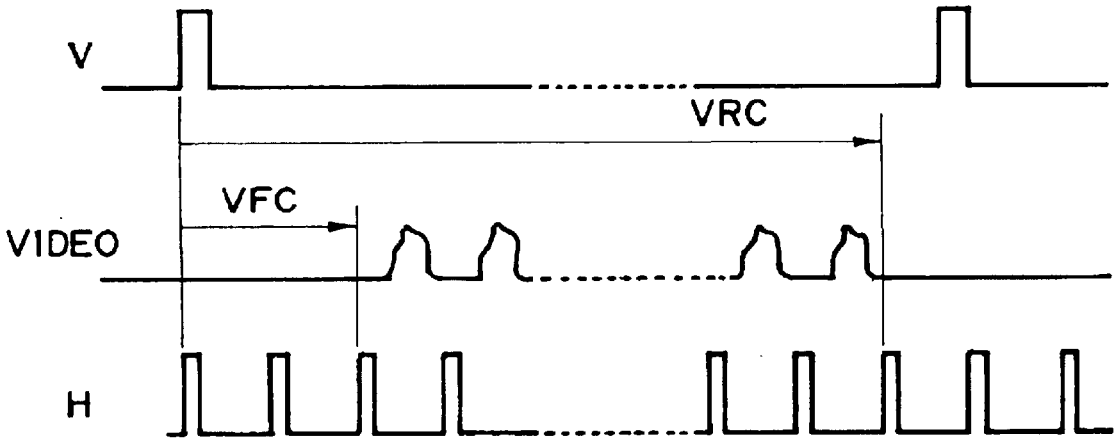
FIG. 3 is a time chart for illustrating an example of a display position relative to a vertical synchronizing signal.
Figure 7:
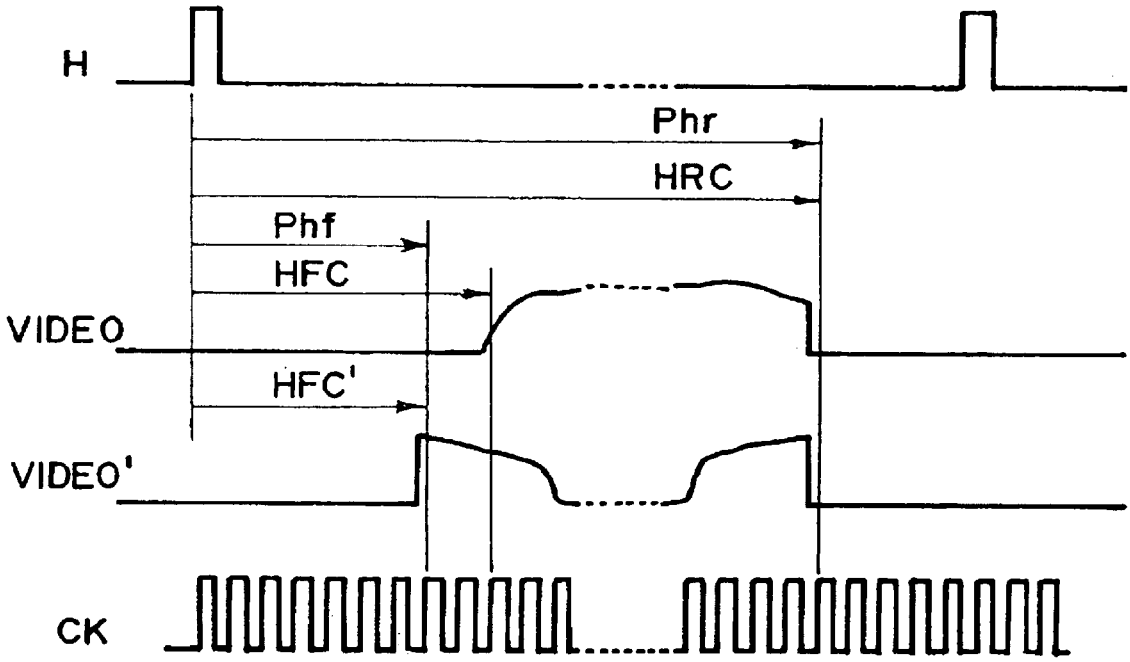
FIG. 7 is a time chart illustrating an example of outputted picture data.

The timing of writing the digital video signals Rd, Gd and Bd in the picture memory is controlled by the display control circuit 4. The video signals R, G and B, the horizontal synchronizing signal H, the vertical synchronizing signal V and the pixel clock signal CK outputted from the picture display unit drive circuit 2, are also inputted to the display position detection circuit 6. The display position detection circuit 6 includes a counter for counting pixel clock pulses CK from a point of rise of the horizontal synchronizing signal H to detect a time HFC based on the number of clock pulses CK corresponding to a point of commencement of inputted video signals R, G, B and a time HRC based on the number of clock pulses CK corresponding to a point of termination (or absence) of the inputted video signals with respect to the horizontal position as shown in FIG. 2. Further, the display position detection circuit 6 also includes a counter for counting the horizontal synchronizing pulses H from a point of rise of the vertical synchronizing signal V to detect a time VFC based on the number of the horizontal synchronizing pulses H corresponding to a point of commencement of the video signals and a time VRC based on the number of horizontal synchronizing pulses H corresponding to a point of termination (or absences of the inputted video signals. The position data HFC, HRC, VFC and VRC detected by the display position detection circuit 6 are inputted to the display control circuit 4, where differences of these values from set picture signal outputting timing values are determined. Based on the differences, the display control circuit 4 controls the timing of writing newly inputted digital signals Rd, Gd an Bd in the picture memory 2*m* contained in the picture display drive circuit 2. For example, at VIDEO, FIG. 7 shows a case where a small difference on the order of several dots is present between the actual memory writing timing and the set memory writing timing, accordingly between the detected horizontal initial display position data HFC and a set horizontal initial display position data Phf. Based on the difference between HFC and Phf, the display control circuit 4 controls the timing of writing newly inputted digital data Rd. Gd and Bd in the picture memory 2*m* in the picture display unit drive circuit 2 according to an adjustment sequence illustrated in a flow chart of FIG. 4 as will be described hereinafter.

On the other hand, in a case in which there is a large difference between the actual memory writing time and the set memory writing time, e.g., a difference of more than 304 dots exceeding a blanking period for inputted picture signals in an assumed case including a total of 1328 dots within an interval between subsequent horizontal synchronizing signals and 1024 display dots, the video signal output from the picture display unit drive circuit 2 assumes a form as shown at VIDEO' in FIG. 7. In FIG. 7, Phr denotes a horizontal picture data output termination, whereas the writing time into the picture memory is deviated by more than a blanking period, and the picture data outputted from the picture display unit drive circuit 2 beginning from time Phf and ending with time Phr is caused to include a blanking period therein. As a result, while the display position is actually remarkably deviated, the display position data HFC and HRC detected by the display position detection circuit 6 happen to be identical to set timing data of Phf and Phr, thus obstructing an accurate adjustment.

For obviating the above difficulty, a minimum degree within a necessary extent of preset data (e.g., ideal pixel memory writing timing data for each of representative resolution formats such as VGA, SVGA and XGA) are stored in the preset data memory 5, and one of such preset format data is stored in advance in the picture display unit drive circuit 2 after judging the inputted signal format in the display control circuit 4, thereby obviating the occurrence of an extreme positional deviation as shown at VIDEO' in FIG. 7. After obviating such an extreme deviation, a minor degree of deviation as shown at VIDEO in FIG. 7 is removed by controlling the timing for writing digital data in the pixel memory in the circuit 2 according to the adjustment flow of FIG. 4.

Incidentally, in the above embodiment, picture signals in three types of R, G and B are inputted in the display position detection circuit 6, but it is possible to adopt a simple scheme of introducing only one type among R, G and B signals.

Figure 4:
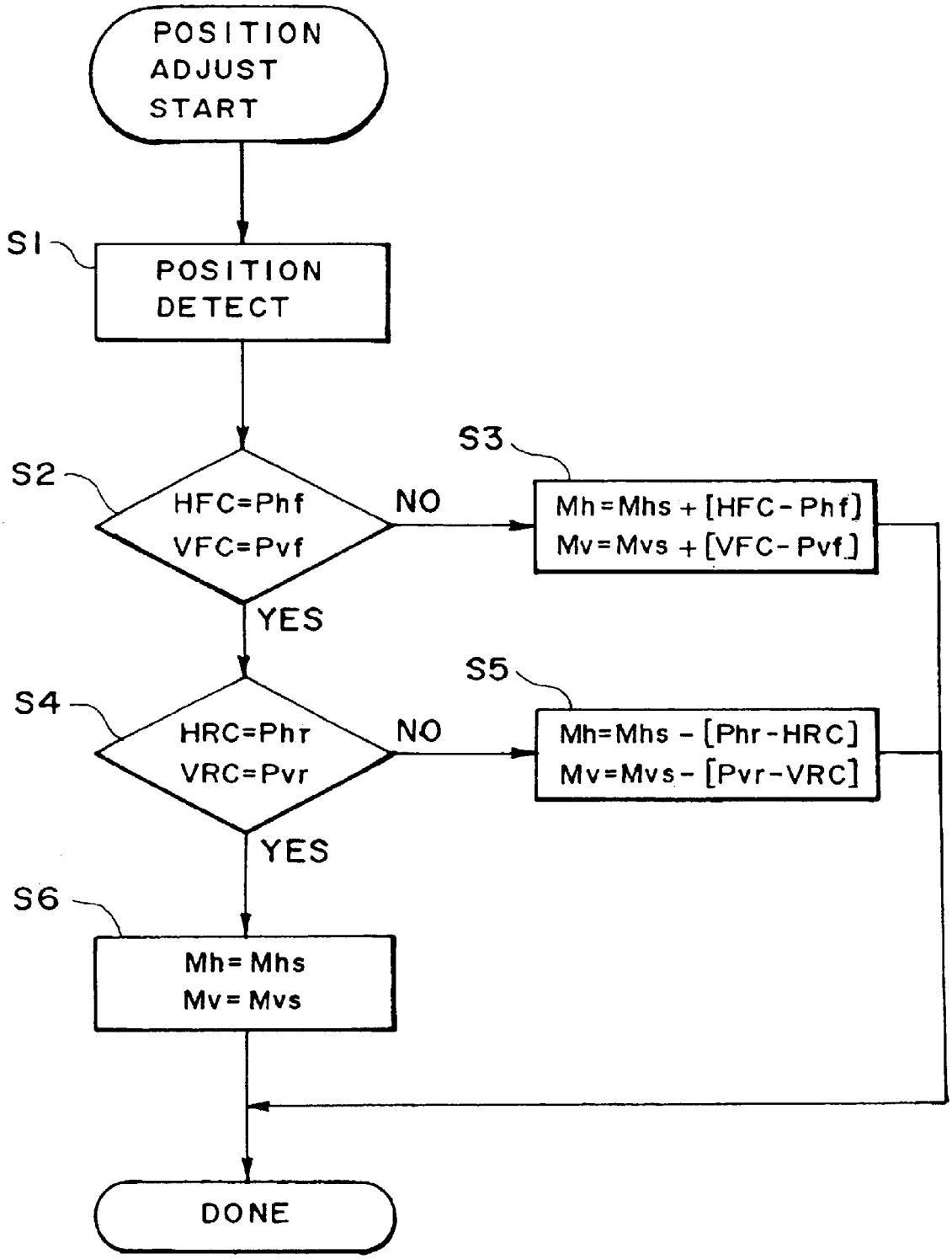
FIG. 4 is a flow chart illustrating a system flow of display position adjustment for the apparatus of FIG. 1.
Figure 5:
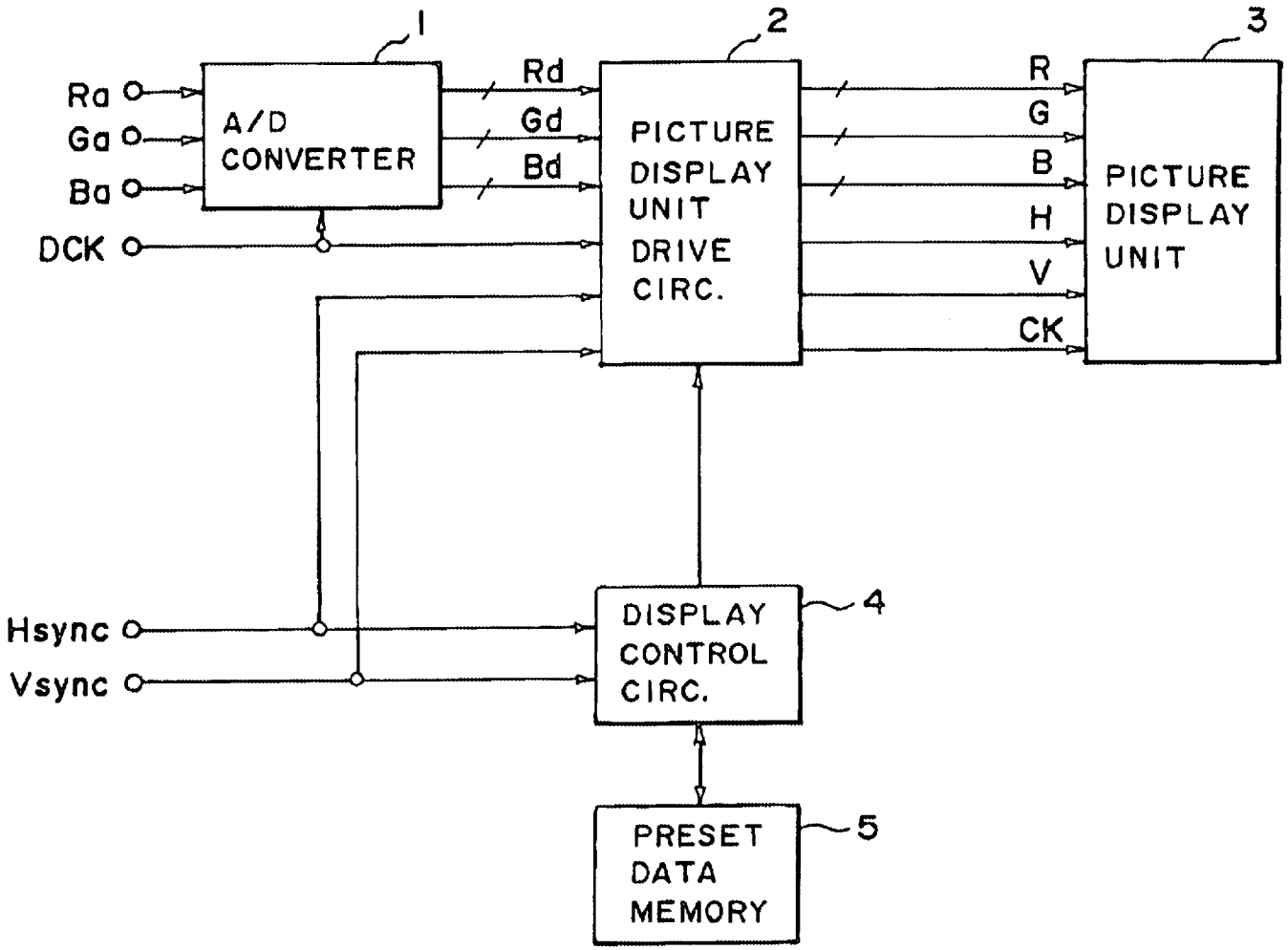
FIG. 5 PRIOR ART
FIGS. 5 and 6 are respectively a block diagram of a conventional picture display apparatus including a picture display adjustment system.
Figure 6:
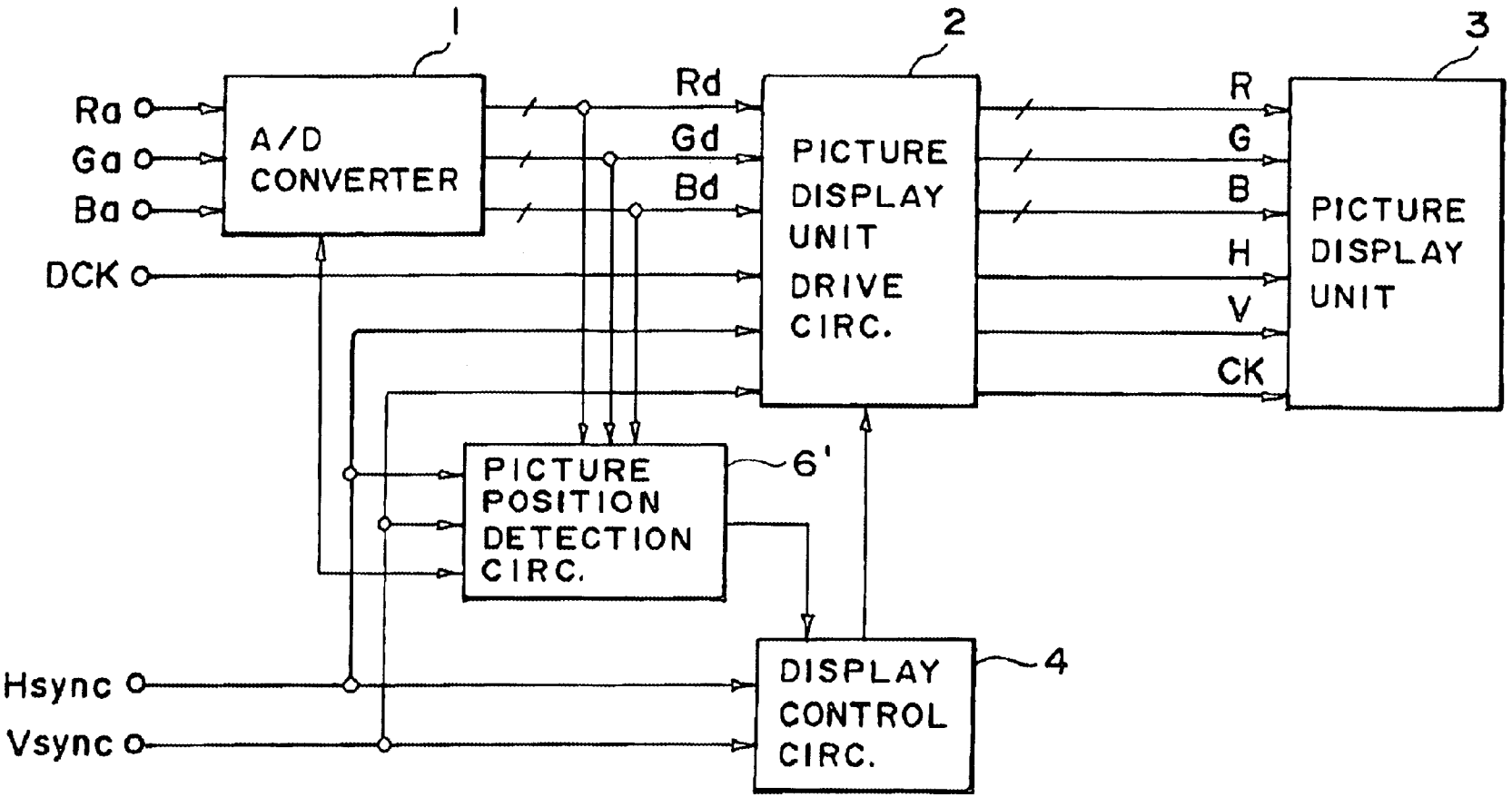
FIG. 6 PRIOR ART

FIG. 4 is a flowchart illustrating a display position adjustment sequence adopted in an embodiment of the picture display apparatus according to the present invention.

Referring to FIG. 4, as a first step S1 of display position adjustment, horizontal and vertical display position data HFC, HRC, VFC and VRC are detected by the display position detection circuit 6. Then, at step S2, the set horizontal output commencement time Phf and vertical output commencement time Pvf from the picture display unit drive circuit 2 are compared with actual horizontal output commencement time HFC and vertical output commencement time VFC, respectively, detected by the display position detection circuit 6. As a result of this comparison, if the compared results are unequal, this means that the timing of writing digital data in the picture memory 2*m* is faster (i.e., too early; on the other hand, in a case in which the time is slower, no positional deviation in display commencement position is recognized as the data is present at the time after reading out of the memory and a prescribed processing of read data), and an operation at step S3 of adjusting a horizontal writing time Mh and a vertical writing time Mv respectively according to the following formulae:

$$Mh=Mhs+[HFC-Phf] \quad (1)$$

$$Mv=Mvs+[VFC-Pvf] \quad (2)$$

wherein Mhs and Mvs denote initial values of horizontal writing and vertical writing, respectively, in the picture memory 2*m*. If the comparison results at step S2 are equal, an operation at step S4 is performed.

At Step 4, the set horizontal output termination time Phr and vertical output termination time Pvr from the picture display unit drive circuit 2 are compared with actual horizontal output termination time HRC and vertical output termination time VRC, respectively, detected by the display position detection circuit 6. As a result of this comparison, if the compared results are unequal, this means that the timing of writing digital data in the picture memory 2*m* is slower (i.e., too late; on the other hand, in a case in which the time is faster, no positional deviation in display termination position is recognized as the data is present at the time after reading out of the memory and prescribed processing of read data), and an operator at step S5 of adjusting the horizontal writing time Mh and a vertical writing time Mr respectively according to the following formulae:

$$Mh=Mhs-[Phr-HRC] \quad (3)$$

$$Mv=Mvs-[Pvr-VRC] \quad (4)$$

If the comparison results at step S4 are equal, an operation at step S6 is performed.

At step S6, the display positions are so that:

$$Mh=Mhs \quad (5)$$

$$Mv=Mvs \quad (6).$$

Then, the display position adjustment is completed. On the other hand, it is also possible to place a step S7 where the initial values Mhs and Mvs are renewed according to the following formulae (7) and (8) based on the values of Mh and Mv according to the above formulae (3) and (4):

$$Mhs=Mh \quad (7)$$

$$Mvs=Mv \quad (8).$$

By effecting the above display position adjustment sequence just before displaying a first picture after turning on power supply to the picture display apparatus or just before displaying a first picture according to a new picture signal format after converting the previous picture signal format to the new picture signal format, it is possible to provide a display system wherein an operator is not aware of a display picture positional deviation.

As described above, according to the present invention, by detecting a picture display position from picture data outputted from a picture display unit drive circuit, it becomes possible to effect an accurate display position detection on a picture display unit. Further, by using the result as a basis for controlling the timing for writing inputted video signals in a picture memory contained in the picture display unit drive circuit, it is possible to realize a good picture free from a partial lack of the picture.

Further, by disposing the display position detection unit in a later stage than the picture display unit drive circuit, i.e., in a drive environment of the picture display unit, the operation speed of the display position detection circuit can be lowered, thereby allowing an operation at a reduced current consumption and adoption of a low-speed device for the circuit, leading to a reduced production cost.

What is claimed is:

1. A picture display apparatus for displaying a picture in response to inputted picture signals of an arbitrary format, said apparatus comprising:

a picture display unit having an arranged matrix of dots for picture display;

picture display unit drive means for converting inputted picture signals into display picture signals adapted for display on the picture display unit and generating drive timing signals for driving the picture display unit, said picture display unit drive means including a picture memory for storing picture signals inputted into the picture memory;

display position detection means, different from said picture display unit drive means, for detecting a picture display position on the picture display unit based on the display picture signals and the drive timing signals, the display picture signals and the drive timing signals being generated by the picture display unit drive means and inputted into the picture display unit; and display position control means for controlling a timing of admission of the inputted picture signals to the picture memory, which is included in said picture display unit drive means, based on the detected display position data from the display position detection means, thereby adjusting a picture display position.

2. A picture display apparatus according to claim 1, wherein said picture display unit drive means generates a horizontal synchronizing signal, a vertical synchronizing signal and a pixel clock signal as the drive timing signals.

3. A picture display apparatus according to claim 2, wherein said display position detection means detects a horizontal commencement position of a picture displayed on the picture display unit in terms of a number of pixel clock signals from a rise of the horizontal synchronizing signal until first detection of the display picture signals, and detects a horizontal termination position of the picture in terms of a number of the pixel clock signals from the rise of the horizontal synchronizing signal until the termination of the display picture signals, respectively, during one horizontal scanning period, and further detects a vertical commencement position of the picture in terms of a number of horizontal synchronizing signals from a rise of the vertical synchronizing signal until first detection of the display picture signals, and detects a vertical termination position of the picture in terms of a number of horizontal synchronizing signals from the rise of the vertical synchronizing signals until the termination of the display picture signals, respectively, in one vertical scanning period, and the display position control means controls a timing of admitting the inputted picture signals into the picture memory in the picture display unit drive means, based on a difference between detected position data and set timing data for outputting display picture signals, thereby automatically adjusting the picture display position.

4. A picture display apparatus according to claim 3, wherein said display position control means is further equipped with a preset data memory for storing ideal values for timing of writing in the picture memory, respectively corresponding to a plurality of formats of the inputted signals, and means for judging a format of the inputted picture signals based on an inputted horizontal synchronizing signal and an inputted vertical synchronizing signal accompanying inputted picture signals and for reading out the ideal value of the judged format of the inputted display picture signals.

* * * * *

UNITED STATES PATENT AND TRADEMARK OFFICE

CERTIFICATE OF CORRECTION

PATENT NO. : 6,927,767 B1
APPLICATION NO. : 09/492568
DATED : August 9, 2005
INVENTOR(S) : Akihiro Ouchi It is certified that error appears in the above-identified patent and that said Letters Patent is hereby corrected as shown below:

Title page,
Item [56], References Cited, FOREIGN PATENT DOCUMENTS, "05072986 A" should read -- 5-72986 A --.

Column 3,
Line 55, "once" should read -- first --.

Signed and Sealed this

Twenty-seventh Day of June, 2006

JON W. DUDAS
*Director of the United States Patent and Trademark Office*